US011364541B2

(12) United States Patent
Takashita et al.

(10) Patent No.: US 11,364,541 B2
(45) Date of Patent: Jun. 21, 2022

(54) PARTIALLY DIFFUSION-ALLOYED STEEL POWDER

(71) Applicant: JFE STEEL CORPORATION, Chiyoda-ku Tokyo (JP)

(72) Inventors: Takuya Takashita, Tokyo (JP); Akio Kobayashi, Tokyo (JP); Naomichi Nakamura, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 5 days.

(21) Appl. No.: 16/768,692

(22) PCT Filed: Nov. 30, 2018

(86) PCT No.: PCT/JP2018/044316
§ 371 (c)(1),
(2) Date: Jun. 1, 2020

(87) PCT Pub. No.: WO2019/111834
PCT Pub. Date: Jun. 13, 2019

(65) Prior Publication Data

US 2021/0138547 A1 May 13, 2021

(30) Foreign Application Priority Data

Dec. 5, 2017 (JP) ..... JP2017-233204

(51) Int. Cl.

| | |
|---|---|
| ***B22F 9/00*** | (2006.01) |
| ***C22C 33/02*** | (2006.01) |
| ***C22C 38/04*** | (2006.01) |
| ***C22C 38/12*** | (2006.01) |
| ***C22C 38/16*** | (2006.01) |

(52) U.S. Cl.
CPC ..... *B22F 9/004* (2013.01); *C22C 33/0207* (2013.01); *C22C 33/0264* (2013.01); *C22C 38/04* (2013.01); *C22C 38/12* (2013.01); *C22C 38/16* (2013.01)

(58) Field of Classification Search
CPC ..... B22F 9/004
See application file for complete search history.

(56) References Cited

U.S. PATENT DOCUMENTS

| | | | |
|---|---|---|---|
| 6,610,120 | B2 | 8/2003 | Nakamura et al. |
| 7,347,884 | B2 | 3/2008 | Unami et al. |
| 7,384,446 | B2 | 6/2008 | Unami et al. |
| 10,207,328 | B2 | 2/2019 | Takashita et al. |
| 10,265,766 | B2 | 4/2019 | Maetani et al. |
| 2005/0039576 | A1 | 2/2005 | Unami et al. |
| 2007/0089562 | A1 | 4/2007 | Unami et al. |
| 2016/0214171 | A1 | 7/2016 | Maetani et al. |
| 2018/0178291 | A1 | 6/2018 | Takashita et al. |
| 2018/0193911 | A1 | 7/2018 | Kobayashi et al. |
| 2021/0138547 | A1 | 5/2021 | Takashita et al. |

FOREIGN PATENT DOCUMENTS

| | | | |
|---|---|---|---|
| CN | 1342780 | A | 4/2002 |
| CN | 100449024 | C | 1/2009 |
| CN | 100515613 | C | 7/2009 |
| CN | 105263653 | A | 1/2016 |
| CN | 105555440 | A | 5/2016 |
| JP | S5645966 | B2 | 10/1981 |
| JP | S59129753 | A | 7/1984 |
| JP | S60165301 | A | 8/1985 |
| JP | H01123001 | A | 5/1989 |
| JP | H0247202 | A | 2/1990 |
| JP | H059501 | A | 1/1993 |
| JP | H07188714 | A | 7/1995 |
| JP | 2002146403 | A | 5/2002 |
| JP | 2002348601 | A | 12/2002 |
| JP | 2003247003 | A | 9/2003 |
| JP | 2005330573 | A | 12/2005 |
| JP | 2014237878 | A | 12/2014 |
| KR | 1020170080668 | A | 7/2017 |
| WO | 2005102564 | A1 | 11/2005 |
| WO | 2015045273 | A1 | 4/2015 |
| WO | 2016088333 | A1 | 6/2016 |
| WO | 2017043094 | A1 | 3/2017 |
| WO | 2017047101 | A1 | 3/2017 |

OTHER PUBLICATIONS

Sep. 3, 2021, Office Action issued by the China National Intellectual Property Administration in the corresponding Chinese Patent Application No. 201880078233.X with English language search report.
Feb. 16, 2019, International Search Report issued in the International Patent Application No. PCT/JP2018/044316.
Jan. 7, 2020, Notification of Reasons for Refusal issued by the Japan Patent Office in the corresponding Japanese Patent Application No. 2019-515563 with English language Concise Statement of Relevance.
Jun. 23, 2021, Office Action issued by the Canadian Intellectual Property Office in the corresponding Canadian Patent Application No. 3,084,618.

(Continued)

*Primary Examiner* — Christopher S Kessler
(74) *Attorney, Agent, or Firm* — Kenja IP Law PC

(57) ABSTRACT

Disclosed is a partially diffusion-alloyed steel powder having excellent fluidity, formability, and compressibility without containing Ni, Cr, and Si. A partially diffusion-alloyed steel powder having excellent fluidity, formability, and compressibility that includes an iron-based powder and Mo diffusionally adhered to a surface of the iron-based powder, in which Mo content is 0.2 mass % to 2.0 mass %, a weight-based median diameter D50 is 40 μm or more, and among particles contained in the partially diffusion-alloyed steel powder, those particles having an equivalent circular diameter of 50 μm to 200 μm have a number average of solidity of 0.70 to 0.86, the solidity being defined as (particle cross-sectional area/envelope-inside area).

6 Claims, No Drawings

(56) References Cited

OTHER PUBLICATIONS

Jul. 28, 2020, the Extended European Search Report issued by the European Patent Office in the corresponding European Patent Application No. 18886309.6.
Mar. 22, 2021, Office Action issued by the Korean Intellectual Property Office in the corresponding Korean Patent Application No. 10-2020-7018383 with English language concise statement of relevance.
Mar. 24, 2021, Communication pursuant to Article 94(3) EPC issued by the European Patent Office in the corresponding European Patent Application No. 18886309.6.

PARTIALLY DIFFUSION-ALLOYED STEEL POWDER

TECHNICAL FIELD

This disclosure relates to a partially diffusion-alloyed steel powder and, in particular, to a partially diffusion-alloyed steel powder having excellent fluidity, formability, and compressibility without containing Ni, Cr, and Si.

BACKGROUND

Powder metallurgical techniques enable manufacture of complicated-shape parts with dimensions very close to the products' shapes (i.e., near net shapes) and with high dimensional accuracy. The use of powder metallurgical techniques in manufacturing parts therefore can significantly reduce machining costs. For this reason, powder metallurgical products manufactured by powder metallurgical techniques have been used as various mechanical parts in many fields. Further, to cope with demands for reductions in size and weight and increasing complexity of parts, requirements for powder metallurgical techniques are becoming more stringent.

Against the above background, requirements for alloyed steel powder used in powder metallurgy are also becoming more rigorous. For example, to ensure workability in filling a press mold with alloyed steel powder for powder metallurgy and forming the alloyed steel powder, alloyed steel powder is required to have excellent fluidity.

Further, sintered parts obtained by sintering alloyed steel powder are required to have excellent mechanical properties. Therefore, the improvement of compressibility is required for ensuring fatigue strength and the improvement of formability is required for preventing chipping of complicated-shape parts.

Moreover, a reduction in costs for manufacturing parts is strongly required, and from such a viewpoint, alloyed steel powder is required to be manufactured in an existing powder manufacturing process without the need of any additional step. Further, although elements for improving quench hardenability are typically added as alloy components to alloyed steel powder for powder metallurgy, alloyed steel powder not containing Ni, which is highest in alloy costs, is required.

As alloyed steel powder not containing Ni, alloyed steel powder added with at least one of Mo, Cr, Si, or Cu is widely used. However, among these elements, Cr and Si have the problem of being oxidized under a RX gas (endothermic converted gas) atmosphere which is typically used as an atmosphere gas for sintering in a sintered part manufacturing process. Therefore, in sintering a formed body manufactured using alloyed steel powder containing Cr or Si, sintering needs to be performed under high-level atmosphere control using $N_2$ or $H_2$. As a result, even if a raw material cost can be reduced by not using Ni, a part manufacturing cost is increased and eventually, a total cost cannot be reduced.

In light thereof, the recent requirements for alloyed steel powder are as follows:

(1) excellent fluidity;
(2) good compressibility;
(3) high formability; and
(4) low cost.

Among alloyed steel powder for powder metallurgy, Mo-based alloyed steel powder in which Mo is used as an element for improving quench hardenability has no concern of oxidation that would occur in the case of using Cr or Si as described above, and the decrease in compressibility through the addition of the element is small. Thus, the Mo-based alloyed steel powder is suitable for parts having high compressibility and complicated shapes. Further, since Mo has even better quench hardenability than Ni, excellent quench hardenability can be exhibited even through the addition of a trace amount of Mo. For the above reason, the Mo-based alloyed steel powder is considered to be the most suitable alloy for satisfying the requirements (1) to (4).

As to techniques with regard to the Mo-based alloyed steel powder, for example, JP 2002-146403 A (PTL 1) proposes an alloyed steel powder having excellent compressibility and cold forgeability in which 0.2 mass % to 10.0 mass % Mo is diffusionally adhered to the surface of an iron-based powder containing Mn.

Meanwhile, for improving the formability, various efforts are made as described below with regard to non-Mo-based alloyed steel powder.

JP H05-009501 A (PTL 2) describes a technique related to Fe—Si—Mn—C-based alloyed steel powder from which a sintered body suitable for quench-hardened members and the like is obtained. The alloyed steel powder has a rattler value as significantly low and good as 0.31% when formed under a pressure of 6 t/cm$^2$, the rattler value being an index of formability.

JP H02-047202 A (PTL 3) describes a technique related to alloyed steel powder obtained by partially diffusing Ni on iron-based powder, and the alloyed steel powder indicates a rattler value as good as 0.4% when formed under a pressure of 6 t/cm$^2$.

JP S59-129753 A (PTL 4) describes a technique related to Fe—Mn—Cr-based alloyed steel powder subjected to vacuum reduction, and the alloyed steel powder has a rattler value as good as 0.35% when formed under a pressure of 6 t/cm$^2$.

JP 2002-348601 A (PTL 5) describes a technique of setting the rattler value to a significantly low value of about 0.2% to 0.3% by applying a copper coating to the surface of iron powder.

CITATION LIST

Patent Literature

PTL 1: JP 2002-146403 A
PTL 2: JP H05-009501 A
PTL 3: JP H02-047202 A
PTL 4: JP S59-129753 A
PTL 5: JP 2002-348601 A

SUMMARY

Technical Problem

However, the conventional techniques described in PTL 1 to PTL 5 have the following problems.

The alloyed steel powder proposed in PTL 1 has excellent compressibility and cold forgeability. However, PTL 1 merely defines the composition of alloyed steel powder. Further, although PTL 1 mentions compressibility, no specific study is made on formability. Thus, the alloyed steel powder proposed in PTL 1 does not satisfy the requirement (3).

On the other hand, although the alloyed steel powder described in PTL 2 has excellent formability, it contains Si and thus needs to be sintered in a specially controlled atmosphere in order to prevent the oxidation of Si described above, thus not satisfying the requirement (4). Further, the alloyed steel powder described in PTL 2 has poor compressibility and a green compact obtained by forming the alloyed steel powder has an extremely low density of 6.77 g/cm$^3$ with a forming pressure of 6 t/cm$^2$. A green compact having this low density is of concern in terms of fatigue strength. Therefore, the alloyed steel powder described in PTL 2 does not satisfy the requirements (2) and (4).

Further, the alloyed steel powder described in PTL 3 needs to contain Ni in an amount as large as 30 mass %, and thus does not satisfy the requirement (4).

Similarly, since the alloyed steel powder described in PTL 4 also needs to contain Cr, the atmosphere control during sintering is necessary, and thus the alloyed steel powder of PTL 4 does not satisfy the requirement (4).

The alloyed steel powder described in PTL 5 needs an additional step in the manufacturing process of raw material powder, that is, applying coating to powder. Further, the amount of Cu used for coating is 20 mass % or more, which is significantly large amount compared with the Cu content in common sintered steel (about 2 mass % to 3 mass %), and as a result, alloyed steel powder costs are increased. Therefore, the alloyed steel powder described in PTL 5 does not satisfy the requirement (4).

As described above, the conventional techniques as described in PTL 1 to PTL 5 cannot produce alloyed steel powder which satisfies all the requirements (1) to (4).

It could thus be helpful to provide a partially diffusion-alloyed steel powder having excellent fluidity, formability, and compressibility without containing Ni, Cr, and Si.

Solution to Problem

The inventors made intensive studies and discovered that the above-described issues can be addressed by the features described below, and this disclosure was completed based on this discovery. Specifically, the features of this disclosure are as follows:

1. A partially diffusion-alloyed steel powder comprising an iron-based powder and Mo diffusionally adhered to a surface of the iron-based powder, wherein Mo content is 0.2 mass % to 2.0 mass %, a weight-based median size D50 is 40 μm or more, and among particles contained in the partially diffusion-alloyed steel powder, those particles having an equivalent circular diameter of 50 μm to 200 μm have a number average of solidity of 0.70 to 0.86, the solidity being defined as (particle cross-sectional area/envelope-inside area).

2. The partially diffusion-alloyed steel powder according to the foregoing 1, wherein Ni, Cr, and Si contents are each 0.1 mass % or less.

3. The partially diffusion-alloyed steel powder according to the foregoing 1 or 2, wherein the iron-based powder contains at least one selected from the group consisting of Cu, Mo, and Mn in a pre-alloyed manner.

Advantageous Effect of Invention

The partially diffusion-alloyed steel powder disclosed herein has excellent fluidity, formability, and compressibility without containing Ni, Cr, and Si. Further, since it is not necessary to contain Ni contributing to a high alloy cost and Cr and Si requiring annealing under a special atmosphere, and an additional manufacturing step such as coating is not necessary, the partially diffusion-alloyed steel powder of this disclosure can be manufactured in an existing powder manufacturing process at a low cost.

DETAILED DESCRIPTION

Detailed description is given below. The following merely provides preferred embodiments of this disclosure, and this disclosure is by no means limited to the description.

Partially Diffusion-Alloyed Steel Powder

The partially diffusion-alloyed steel powder according to the present disclosure is a partially diffusion-alloyed steel powder comprising an iron-based powder and Mo diffusionally adhered to the surface of the iron-based powder. In other words, the partially diffusion-alloyed steel powder disclosed herein is a powder comprising an iron-based powder and Mo diffusionally adhered to a surface of the iron-based powder. As used herein, the term "iron-based powder" refers to a metal powder containing Fe in an amount of 50 mass % or more.

In the present disclosure, it is important to control the Mo content, the median size, and the number average of the solidity within particular ranges. The reasons for limiting the items are described below.

Mo Content: 0.2 Mass % to 2.0 Mass %

The partially diffusion-alloyed steel powder disclosed herein contains Mo, as an essential component, which is diffusionally adhered to a surface of the iron-based powder. Containing Mo as an element forming an a phase can accelerate sintering diffusion. Also, when the iron-based powder contains a large amount of Mo as a pre-alloy, the compressibility of particles is lowered through solid solution strengthening, making densification difficult. On the other hand, the diffusional adhesion of Mo may avoid a decrease in compressibility even when adding a large amount of Mo. The diffusional adhesion of Mo also has the effect of stabilizing the secondary particles generated by heat treatment by means of α-phase sintering. To obtain these effects, the Mo content in the entire partially diffusion-alloyed steel powder is 0.2 mass % or more. The Mo content is preferably 0.3 mass % or more, and more preferably 0.4 mass % or more. On the other hand, when the Mo content exceeds 2.0 mass %, the sintering accelerating effect reaches a plateau, causing a decrease in compressibility. Therefore, the Mo content in the entire partially diffusion-alloyed steel powder is 2.0 mass % or less. The Mo content is preferably 1.5 mass % or less, and more preferably 1.0 mass % or less.

The chemical composition of the partially diffusion-alloyed steel powder disclosed herein is not particularly limited except for the Mo content, and may be freely formulated. However, since the partially diffusion-alloyed steel powder is obtained by diffusionally adhering Mo to the iron-based powder, it is usually preferable that the Fe content in the entire partially diffusion-alloyed steel powder is 50 mass % or more, preferably 80 mass % or more, more preferably 90 mass % or more, and even more preferably 95 mass % or more. On the other hand, no upper limit is placed on the Fe content. For example, the entire partially diffusion-alloyed steel powder may have a chemical composition consisting of Mo and Fe, with the balance being inevitable impurities.

Examples of the inevitable impurities include C, O, N, S, and P. It is noted that by reducing the contents of inevitable impurities, it is possible to further improve the compressibility of the powder and to obtain an even higher forming density. Therefore, the C content is preferably 0.02 mass % or less. The O content is preferably 0.3 mass % or less, and more preferably 0.25 mass % or less. The N content is preferably 0.004 mass % or less. The S content is preferably 0.03 mass % or less. The P content is preferably 0.1 mass % or less.

The partially diffusion-alloyed steel powder may optionally contain additional alloying elements. When any additional alloying element(s) are used, they are preferably contained in the iron-based powder. In other words, a pre-alloyed steel powder containing the additional alloying element(s) may be used as the iron-based powder. The additional alloying element(s) may be, for example, at least one element selected from the group consisting of Cu, Mo, and Mn. It is noted that the partially diffusion-alloyed steel powder disclosed herein may be an alloyed steel powder obtained by pre-alloying an iron-based powder with Mo and further diffusionally adhering Mo to the iron-based powder (i.e., a hybrid alloyed steel powder). In this case, the Mo content in the entire partially diffusion-alloyed steel powder (hybrid alloyed steel powder) is also set in the above range. Further, Mn is oxidized, as in Si and Cr, during sintering, causing the properties of sintered body to deteriorate. Therefore, the Mn content in the iron-based powder is preferably 0.5 mass % or less.

If additional alloying elements are not used, iron powder may be used as the iron-based powder. As used herein, the term "iron powder" refers to a powder consisting of Fe and inevitable impurities (which is commonly referred to as "pure iron powder" in the art).

The partially diffusion-alloyed steel powder disclosed herein does not need to contain Ni, Cr, and Si, which are conventionally used. Since Ni leads to an increased alloy cost, the Ni content in the entire partially diffusion-alloyed steel powder is preferably set to 0.1 mass % or less, and it is more preferable that the partially diffusion-alloyed steel does not substantially contain Ni. Further, as described above, since Cr is easily oxidized and requires the control of an annealing atmosphere, the Cr content in the entire partially diffusion-alloyed steel powder is preferably set to 0.1 mass % or less, and it is more preferable that the partially diffusion-alloyed steel powder does not substantially contain Cr. For the same reason as Cr, the Si content in the entire partially diffusion-alloyed steel powder is preferably set to 0.1 mass % or less, and it is more preferable that the partially diffusion-alloyed steel powder does not substantially contain Si. The expression "not substantially contain" means that an element is not contained except as an inevitable impurity, and it is thus acceptable that the element may be contained as an inevitable impurity.

In other words, the partially diffusion-alloyed steel powder in one embodiment of the present disclosure may have a chemical composition consisting of, in mass %, Mo: 0.2% to 2.0%,
Ni: 0% to 0.1%,
Cr: 0% to 0.1%, and
Si: 0% to 0.1%, with the balance being Fe and inevitable impurities.

D50: 40 μm or More

When the partially diffusion-alloyed steel powder has a weight-based median size D50 (hereinafter, simply referred to as "D50") of less than 40 μm, the ratio of fine particles within the entire alloy steel powder becomes too high, resulting in lower compressibility. Therefore, D50 is 40 μm or more. D50 is preferably 65 μm or more. Although no upper limit is placed on D50, excessively large D50 deteriorates the mechanical properties after sintering. Therefore, considering the properties after sintering, D50 is preferably 120 μm or less.

The maximum particle size of the partially diffusion-alloyed steel powder is not particularly limited, yet it is preferably 212 μm or less. As used herein, the maximum particle size of 212 μm or less means that the partially diffusion-alloyed steel powder is a powder passing through a sieve having an opening size of 212 μm.

Solidity: 0.70 to 0.86

In the partially diffusion-alloyed steel powder of this disclosure, it is important that among particles contained in the partially diffusion-alloyed steel powder, those particles having an equivalent circular diameter of 50 μm to 200 μm have a number average of solidity of 0.70 or more and 0.86 or less, the solidity being defined as (particle cross-sectional area/envelope-inside area). In the following description, the number average of the solidity of particles having an equivalent circular diameter of 50 μm to 200 μm, the solidity being defined as (particle cross-sectional area/envelope-inside area), is referred to simply as "solidity".

The solidity is an index indicating the roughness degree of a particle surface. A lower solidity indicates a higher roughness degree of a particle surface. By setting the solidity to 0.86 or less, the entanglement between particles during forming is promoted, and as a result, the formability is improved. The solidity is preferably set to 0.85 or less, and more preferably 0.83 or less. On the other hand, an excessively low solidity lowers the fluidity of the powder. Therefore, the solidity is 0.70 or more.

Similar indexes include the particle circularity, which is lowered not only by an increase in the roughness of a particle surface but also by elongation of a particle in a needle shape. Since elongated particles do not contribute to the improvement of the formability, the particle circularity is not suitable as the index of the formability.

The solidity can be obtained by image interpretation of the projected images of the particles. Devices that can calculate the solidity include Morphologi G3 available from Malvern Panalytical and CAMSIZER X2 available from Verder Scientific Co., Ltd., and any of these devices can be used. Further, in measuring the solidity, at least 10,000 particles, preferably 20,000 particles are measured to calculate the solidity as the number average of these particles.

Production Method

Next, a method of producing the partially diffusion-alloyed steel powder according to the present disclosure will be described. The partially diffusion-alloyed steel powder disclosed herein is obtainable by mixing an iron-based powder and a Mo raw material powder as raw materials, and then maintaining the mixture at a high temperature such that Mo is diffusionally adhered to the surface of the iron-based powder.

Iron-Based Powder

The iron-based powder may be any metal powder as long as it contains 50% or more of Fe. As described above, although it is possible to use pre-alloyed steel powder containing an alloying element as the iron-based powder, pure iron powder is also usable.

As the iron-based powder, it is possible to use any iron-based powder such as reduced iron-based powder produced by reducing iron oxide or atomized iron-based powder produced by an atomizing method. However, since reduced iron-based powder contains a relatively large amount of impurities such as Si, atomized iron-based powder is preferred.

Although the average particle size of iron-based powder is not particularly limited, the partially diffusion-alloyed steel powder after subjecting to partial alloying has an average particle size substantially equivalent to that of the iron-based powder as the raw material. Therefore, from the viewpoint of suppressing a reduction in the yield rate in the subsequent step such as sieving, it is preferable to use the one with an average particle size close to that of partially-alloyed steel powder.

Further, the number frequency of particles having a particle size of 20 μm or less in the entire iron-based powder is set to 60% or more. When the number frequency is set to 60% or more, secondary particles in which fine iron-based powder having a particle size of 20 μm or less are adhered to the surface of another iron-based powder are formed, and as a result, the solidity can be set to 0.86 or less. On the other hand, when the number frequency of fine powder having a particle size of 20 μm or less is excessively high, D50 of the alloyed steel powder after final reduction decreases. Therefore, the number frequency is set to 90% or less.

Measuring methods of the number frequency include a laser diffraction method and an image interpretation method, any of which may be used. Iron-based powder satisfying the above number frequency condition can be obtained by, for example, adjusting spray conditions for atomization Further, such iron-based powder can be obtained by mixing particles having a particle size of beyond 20 μm and particles having a particle size of 20 μm or less.

The maximum particle size of iron-based powder is not particularly limited, yet it is preferably 212 μm or less. As used herein, a maximum particle size of 212 μm or less means that the iron-based powder as raw material passes through a sieve having an opening size of 212 μm.

Mo Raw Material Powder

The Mo raw material powder is a powder that functions as a Mo source in the diffusional adhesion step to be described later. The Mo raw material powder may be any powder as long as it contains Mo as an element. Thus, as the Mo raw material powder, any of metal Mo powder (powder consisting only of Mo), Mo alloy powder, and Mo compound powder may be used. The Mo alloy powder may be, for example, Fe—Mo (ferromolybdenum) powder. The Mo compound powder may be, for example, at least one selected from the group consisting of Mo oxide, Mo carbide, Mo sulfide, and Mo nitride. These Mo raw material powders may be used alone or in combination.

Mixing

The iron-based powder and the Mo raw material powder as described above are mixed to obtain a mixed powder. In the mixing, the mix proportion of the iron-based powder and the Mo-containing powder is adjusted such that the Mo content in the resulting partially diffusion-alloyed steel powder as a whole is 0.2 mass % to 2.0 mass %. The mixing method is not particularly limited, yet it may be a conventional method using a Henschel mixer, a cone mixer, or the like.

Then, heat treatment is performed to hold the mixed powder at a high temperature. Through the heat treatment, Mo is partially diffused into the iron-based powder from the contact surface between the iron-based powder and the Mo raw material powder, and a partially diffusion-alloyed steel powder in which Mo is diffusionally adhered to the surface of the iron-based powder is obtained.

As the atmosphere of the heat treatment, a reducing atmosphere, in particular, a hydrogen atmosphere is suitable. The heat treatment may be performed under vacuum. For example, when using a Mo compound such as oxidized Mo powder as the Mo raw material powder, the temperature of the heat treatment is preferably in a range of 800° C. to 1100° C. If the temperature is lower than 800° C., decomposition of the Mo compound is insufficient and Mo does not diffuse into the iron powder, making adhesion of Mo difficult. Further, if the temperature is higher than 1100° C., sintering of powder particles progresses excessively during the heat treatment, resulting in an increase of the solidity. On the other hand, in the case of using a Mo alloy such as metal Mo powder or Fe—Mo, a preferred heat treatment temperature is in a range of 600° C. to 1100° C. If the temperature is lower than 600° C., Mo is insufficiently diffused to the iron-based powder, making adhesion of Mo difficult. On the other hand, if the temperature is higher than 1100° C., sintering of powder particles progresses excessively during the heat treatment, causing resulting in an increase of the solidity.

When heat treatment, i.e., diffusional adhesion treatment is performed as mentioned above, the iron-based powder and the Mo-containing powder are normally in a state of being sintered and agglomerated. Therefore, they are ground and classified into desired particle sizes. Specifically, coarse powder is removed by additional grinding or classification using a sieve with predetermined openings according to need, to achieve a desired particle size.

In this way, the partially-alloyed steel powder according to the present disclosure can be produced by a conventional powder production process without any additional process such as coating.

As in conventional powder metallurgy powder, the partially diffusion-alloyed steel powder disclosed herein may be sintered into a sintered body after subjection to pressing.

In the case of performing pressing, it is possible to optionally add an auxiliary material to the partially diffusion-alloyed steel powder. As the auxiliary raw material, for example, one or both of copper powder and graphite powder may be used.

In the pressing, it is also possible to mix the partially diffusion-alloyed steel powder with a powder-like lubricant. Moreover, forming of the alloyed steel powder may be performed with a lubricant being applied or adhered to a mold used for the pressing. In either case, as the lubricant, any of metal soap such as zinc stearate and lithium stearate and amide-based wax such as ethylene bis stearamide may be used. In the case of mixing the lubricant, the amount of the lubricant is preferably about 0.1 parts by mass to 1.2 parts by mass with respect to 100 parts by mass of the partially diffusion-alloyed steel powder.

The method of the pressing is not particularly limited, and may be any method as long as it enables forming of mixed powder for powder metallurgy. At this time, when the pressing force in the pressing is less than 400 MPa, the density of the resulting formed body (green compact) is lowered, and as a result, the properties of the resulting sintered body may be deteriorated. On the other hand, when the pressing force is more than 1000 MPa, the life of the press mold used for the pressing is shortened, which is economically disadvantageous. Therefore, the pressing force is preferably set to 400 MPa to 1000 MPa. Further, the temperature during the pressing is preferably set to normal temperature (20° C.) to 160° C.

The formed body thus obtained has high density and excellent formability. Further, since the partially diffusion-alloyed steel powder disclosed herein does not require elements requiring sintering atmosphere control, such as Cr and Si, sintering can be performed in a conventional inexpensive process.

EXAMPLES

Although the present disclosure will be described below in further detail with reference to examples, the disclosure is not intended to b e limited in any way to the following examples.

Example 1

Mo-based partially diffusion-alloyed steel powder samples were prepared by mixing iron-based powder and Mo raw material powder as raw materials and subjecting the mixture to heat treatment.

As the iron-based powder, atomized iron powder was used. The atomized iron powder was a so-called as-atomized powder, consisting of Fe and inevitable impurities (i.e., pure iron powder), that was not subjected to heat treatment after being produced by the atomization method. The iron-based powder did not contain Ni, Cr, or Si except for inevitable impurities, and thus the contents of Ni, Cr, and Si were 0.1 mass % or less, respectively.

Table 1 lists the number frequency of particles having a particle size of 20 μm or less contained in the pure iron powder used. The number frequency was measured by image interpretation using Morphologi G3 available from Malvern Panalytical.

Further, as the Mo raw material powder, oxidized Mo powder having an average particle size of 10 μm was used.

The above-described oxidized Mo powder was added to the above-described pure iron powder at a ratio such that the Mo content in each resulting partially diffusion-alloyed steel powder was as listed in Table 1, and was mixed together for 15 minutes in a V-mixer. Then, heat treatment (holding temperature: 880° C., holding time: 1 h) was performed in a hydrogen atmosphere with a dew point of 30° C. to obtain a partially-alloyed steel powder with diffusionally adhered Mo.

For each of the obtained partially diffusion-alloyed steel powder samples, image interpretation was performed to measure the number average of the solidity of particles having an equivalent circle diameter of 50 μm to 200 μm. For the image interpretation, Malvern Morphologi G3 was used, as was the case with the iron powder as raw material. Further, D50 of each partially diffusion-alloyed steel powder sample was measured by sieving.

In addition, the fluidity of each obtained partially diffusion-alloyed steel powder sample was evaluated. In the evaluation of fluidity, 100 g of each partially diffusion-alloyed steel powder sample was dropped through a nozzle with a diameter of 5 mm, and those samples were judged as "passed" if the entire amount flowed through the nozzle without stopping, or "failed" if the entire or partial amount stopped and did not flow through the nozzle.

After adding 1 part by mass of zinc stearate as a lubricant with respect to 100 parts by mass of each partially diffusion-alloyed steel powder sample, the resulting powder was formed to ϕ11 mm and 11 mm high under a forming pressure of 686 MPa, to obtain a green compact. The density of each obtained green compact was calculated from its size and weight. The density of each green compact can be regarded as an index of the compressibility of the corresponding partially diffusion-alloyed steel powder sample. From the viewpoint of compressibility, those samples having a density of 7.20 $Mg/m^3$ or higher are considered acceptable.

Then, in order to evaluate the formability, each green compact was subjected to a rattler test prescribed in JAPAN POWDER METALLURGY ASSOCIATION (JPMA) P 11-1992 to measure its rattler value. For rattler values, 0.4% or less is considered acceptable.

The measurement results are as listed in Table 1. From these results, it can be found that the partially diffusion-alloyed steel powder samples satisfying the conditions of the present disclosure exhibited excellent fluidity, compressibility, and formability. Further, the partially diffusion-alloyed steel powder according to the present disclosure neither needs to contain Ni contributing to a high alloy cost or Cr and Si requiring annealing under a special atmosphere, nor to be subjected to any additional production step such as coating. Therefore, the partially diffusion-alloyed steel powder according to the present disclosure can be produced by a conventional powder production process at a low cost.

TABLE 1

| | Pure iron powder | | | | | Green compact | | |
|---|---|---|---|---|---|---|---|---|
| | Number frequency | Partially diffusion-alloyed steel powder | | | | Compressibility | Formability | |
| No. | of 20 μm or less (%) | Mo content (mass %) | Solidity (—) | D50 (μm) | Fluidity | Density ($Mg/m^3$) | Rattler value (%) | Remarks |
| 1 | 50 | 0.4 | 0.88 | 75 | passed | 7.24 | 0.45 | Comparative Example |
| 2 | 60 | 0.4 | 0.86 | 73 | passed | 7.24 | 0.37 | Example |
| 3 | 65 | 0.4 | 0.83 | 70 | passed | 7.23 | 0.35 | Example |
| 4 | 68 | 0.4 | 0.82 | 65 | passed | 7.24 | 0.31 | Example |
| 5 | 80 | 0.4 | 0.78 | 50 | passed | 7.23 | 0.26 | Example |
| 6 | 63 | 0.4 | 0.84 | 120 | passed | 7.28 | 0.32 | Example |
| 7 | 65 | 0.4 | 0.84 | 100 | passed | 7.27 | 0.32 | Example |
| 8 | 64 | 0.4 | 0.83 | 90 | passed | 7.26 | 0.35 | Example |
| 9 | 65 | 0.4 | 0.83 | 50 | passed | 7.22 | 0.34 | Example |
| 10 | 68 | 0.4 | 0.82 | 40 | passed | 7.20 | 0.33 | Example |
| 11 | 68 | 0.4 | 0.82 | 30 | failed | 7.18 | 0.33 | Comparative Example |
| 12 | 64 | 0.1 | 0.90 | 66 | passed | 7.25 | 0.55 | Comparative Example |
| 13 | 65 | 0.2 | 0.86 | 67 | passed | 7.24 | 0.38 | Example |
| 14 | 66 | 0.3 | 0.86 | 67 | passed | 7.24 | 0.40 | Example |

TABLE 1-continued

| | Pure iron powder | | | | | Green compact | | |
|---|---|---|---|---|---|---|---|---|
| | Number frequency | Partially diffusion-alloyed steel powder | | | | Compressibility | Formability | |
| No. | of 20 μm or less (%) | Mo content (mass %) | Solidity (—) | D50 (μm) | Fluidity | Density ($Mg/m^3$) | Rattler value (%) | Remarks |
| 15 | 65 | 0.8 | 0.82 | 66 | passed | 7.22 | 0.30 | Example |
| 16 | 67 | 1.0 | 0.81 | 68 | passed | 7.22 | 0.30 | Example |
| 17 | 65 | 1.5 | 0.81 | 65 | passed | 7.21 | 0.29 | Example |
| 18 | 64 | 1.8 | 0.80 | 68 | passed | 7.20 | 0.28 | Example |
| 19 | 65 | 2.0 | 0.80 | 67 | passed | 7.20 | 0.27 | Example |
| 20 | 65 | 2.5 | 0.78 | 68 | passed | 7.19 | 0.27 | Comparative Example |

Example 2

Partially diffusion-alloyed steel powder samples were prepared under the same conditions as in Example 1, except for the use of iron-based powder (pre-alloyed steel powder) containing, instead of pure iron powder, at least one selected from the group consisting of Cu, Mo, and Mn, with the balance being Fe and inevitable impurities. The iron-based powder was atomized iron-based powder produced by an atomizing method. The contents of Cu, Mo, and Mn in the iron-based powder used are listed in Table 2.

Table 2 lists the number frequency of particles having a particle size of 20 μm or less contained in the iron-based powder used. The number frequency was measured in the same way as in Example 1.

The above-described oxidized Mo powder was added to the above-described iron-based powder at a ratio such that the Mo content in each resulting partially diffusion-alloyed steel powder was as listed in Table 2, and was mixed together for 15 minutes in a V-mixer. Then, heat treatment (holding temperature: 880° C., holding time: 1 h) was performed in a hydrogen atmosphere with a dew point of 30° C. to obtain a partially-alloyed steel powder with diffusionally adhered Mo.

For each of the obtained partially diffusion-alloyed steel powder samples, image interpretation was performed to measure the number average of the solidity of particles having an equivalent circle diameter of 50 μm to 200 μm. The image interpretation was conducted in the same way as in Example 1. Further, D50 of each partially diffusion-alloyed steel powder sample was measured by sieving.

In addition, the fluidity of each obtained partially diffusion-alloyed steel powder sample was evaluated. The evaluation of the fluidity was conducted in the same way as in Example 1.

After adding 1 part by mass of zinc stearate as a lubricant with respect to 100 parts by mass of each partially diffusion-alloyed steel powder, the resulting powder was formed to ϕ11 mm and 11 mm high under a forming pressure of 686 MPa, to obtain a green compact. The density of each obtained green compact was calculated from its size and weight. The density of each green compact can be regarded as an index of the compressibility of the corresponding partially diffusion-alloyed steel powder sample. From the viewpoint of compressibility, those samples having a density of 7.20 $Mg/m^3$ or higher are considered acceptable.

Then, in order to evaluate the formability, each green compact was subjected to a rattler test in the same way as in Example 1 to measure its rattler value. For rattler values, 0.4% or less is considered acceptable.

The measurement results are as listed in Table 2. From these results, it can be found that the partially diffusion-alloyed steel powder samples satisfying the conditions of the present disclosure exhibited excellent fluidity, compressibility, and formability even when the iron-based powder contained at least one selected from the group consisting of Cu, Mo, and Mn in a pre-alloyed manner.

TABLE 2

| | Pure iron powder | | | | Partially diffusion-alloyed steel powder | | | | Green compact | | |
|---|---|---|---|---|---|---|---|---|---|---|---|
| | Number frequency | Alloy components | | | | Area | | | Compressibility | Formability | |
| No. | of 20 μm or less (%) | Cu (mass %) | Mo (mass %) | Mn (mass %) | Mo content (mass %) | envelope (—) | D50 (μm) | Fluidity | Density ($Mg/m^3$) | Rattler value (%) | Remarks |
| 21 | 59 | — | — | 0.2 | 0.6 | 0.85 | 75 | passed | 7.25 | 0.37 | Example |
| 22 | 60 | — | — | 0.5 | 0.6 | 0.84 | 74 | passed | 7.24 | 0.36 | Example |
| 23 | 59 | — | — | 0.8 | 0.6 | 0.85 | 75 | passed | 7.24 | 0.35 | Example |
| 24 | 58 | — | — | 1.0 | 0.6 | 0.85 | 75 | passed | 7.23 | 0.34 | Example |
| 25 | 60 | 1.5 | — | — | 0.6 | 0.85 | 74 | passed | 7.22 | 0.37 | Example |
| 26 | 60 | 2.0 | — | — | 0.6 | 0.86 | 73 | passed | 7.23 | 0.36 | Example |
| 27 | 58 | 3.0 | — | — | 0.6 | 0.85 | 75 | passed | 7.24 | 0.37 | Example |
| 28 | 58 | 4.0 | — | — | 0.6 | 0.84 | 75 | passed | 7.24 | 0.36 | Example |
| 29 | 60 | 1.5 | — | 0.5 | 0.6 | 0.85 | 76 | passed | 7.22 | 0.34 | Example |
| 30 | 60 | 2.0 | — | 0.5 | 0.6 | 0.83 | 75 | passed | 7.22 | 0.35 | Example |
| 31 | 59 | 3.0 | — | 0.5 | 0.6 | 0.84 | 75 | passed | 7.23 | 0.36 | Example |
| 32 | 60 | 4.0 | — | 0.5 | 0.6 | 0.85 | 75 | passed | 7.24 | 0.35 | Example |
| 33 | 59 | 1.5 | 0.7 | 0.5 | 0.6 | 0.84 | 75 | passed | 7.21 | 0.34 | Example |
| 34 | 60 | 2.0 | 0.7 | 0.5 | 0.6 | 0.85 | 73 | passed | 7.22 | 0.35 | Example |
| 35 | 58 | 3.0 | 0.7 | 0.5 | 0.6 | 0.85 | 72 | passed | 7.22 | 0.36 | Example |
| 36 | 58 | 4.0 | 0.7 | 0.5 | 0.6 | 0.85 | 75 | passed | 7.23 | 0.36 | Example |
| 37 | 59 | 1.5 | 0.9 | 0.5 | 0.6 | 0.85 | 74 | passed | 7.21 | 0.37 | Example |
| 38 | 59 | 2.0 | 0.9 | 0.5 | 0.6 | 0.83 | 73 | passed | 7.22 | 0.36 | Example |

TABLE 2-continued

| | Pure iron powder | | | | Partially diffusion-alloyed steel powder | | | | Green compact | | |
|---|---|---|---|---|---|---|---|---|---|---|---|
| | Number frequency | Alloy components | | | | Area | | | Compressibility | Formability | |
| No. | of 20 μm or less (%) | Cu (mass %) | Mo (mass %) | Mn (mass %) | Mo content (mass %) | envelope (—) | D50 (μm) | Fluidity | Density ($Mg/m^3$) | Rattler value (%) | Remarks |
| 39 | 59 | 3.0 | 0.9 | 0.5 | 0.6 | 0.84 | 75 | passed | 7.22 | 0.36 | Example |
| 40 | 60 | 4.0 | 0.9 | 0.5 | 0.6 | 0.83 | 75 | passed | 7.23 | 0.36 | Example |

The invention claimed is:

1. A partially diffusion-alloyed steel powder comprising an iron-based powder and Mo diffusionally adhered to a surface of the iron-based powder, wherein Mo content is 0.2 mass % to 2.0 mass %, a weight-based median size D50 is 40 μm or more and 120 μm or less, and among particles contained in the partially diffusion-alloyed steel powder, those particles having an equivalent circular diameter of 50 μm to 200 μm have a number average of solidity of 0.70 to 0.86, the solidity being defined as (particle cross-sectional area/envelope-inside area).

2. The partially diffusion-alloyed steel powder according to claim 1, wherein Ni, Cr, and Si contents are each 0.1 mass % or less.

3. The partially diffusion-alloyed steel powder according to claim 2, wherein the iron-based powder contains at least one selected from the group consisting of Cu, Mo, and Mn in a pre-alloyed manner.

4. The partially diffusion-alloyed steel powder according to claim 2, wherein the iron-based powder contains Cu in a pre-alloyed manner.

5. The partially diffusion-alloyed steel powder according to claim 1, wherein the iron-based powder contains at least one selected from the group consisting of Cu, Mo, and Mn in a pre-alloyed manner.

6. The partially diffusion-alloyed steel powder according to claim 1, wherein the iron-based powder contains Cu in a pre-alloyed manner.

* * * * *